US007011728B2

(12) United States Patent
Dewig et al.

(10) Patent No.: US 7,011,728 B2
(45) Date of Patent: Mar. 14, 2006

(54) CONTAINER-LABELING AND-PRINTING SYNCHRONIZATION APPARATUS AND PROCESS

(75) Inventors: Joseph M. Dewig, Mount Vernon, IN (US); Randy A. Bowlds, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 322 days.

(21) Appl. No.: 09/909,284

(22) Filed: Jul. 19, 2001

(65) Prior Publication Data

US 2003/0015105 A1 Jan. 23, 2003

(51) Int. Cl.

| | |
|---|---|
| ***B65C 3/08*** | (2006.01) |
| ***B65C 9/06*** | (2006.01) |
| ***B41F 17/08*** | (2006.01) |
| ***B41L 3/02*** | (2006.01) |

(52) U.S. Cl. ..... 156/277; 156/384; 156/387; 156/566; 101/38.1; 101/486; 101/35

(58) Field of Classification Search ..... 101/485, 101/40, 38.1, 490, 350, 484, 177, 43, 35, 101/350.1; 156/64, 356, 360, 384, 354, 277, 156/387, 215, 362

See application file for complete search history.

(56) References Cited

U.S. PATENT DOCUMENTS

| | | | | | |
|---|---|---|---|---|---|
| 1,956,862 | A | * | 5/1934 | Gantz | 156/385 |
| 3,291,675 | A | * | 12/1966 | Orkiff et al. | 156/385 |
| 3,625,412 | A | | 12/1971 | Rosenburg, Jr. | 229/157 |
| 3,661,075 | A | | 5/1972 | Amberg | 101/40 |
| 3,685,441 | A | | 8/1972 | Aebersold et al. | 101/40.1 |
| 3,695,176 | A | | 10/1972 | Van Der Roer | 101/39 |
| 3,710,712 | A | | 1/1973 | Demierre | 101/39 |
| 3,739,975 | A | | 6/1973 | Davidow | 229/116.3 |
| 3,867,882 | A | | 2/1975 | Ahlgren et al. | 101/35 |
| 3,905,292 | A | | 9/1975 | Rossi | 101/40 |
| RE28,732 | E | * | 3/1976 | von Hofe | 156/64 |
| 4,042,445 | A | * | 8/1977 | Klund et al. | 156/385 |
| 4,119,482 | A | * | 10/1978 | Bennett | 156/351 |
| 4,287,824 | A | | 9/1981 | Boyle | 101/45 |
| 4,306,367 | A | | 12/1981 | Otto | 40/312 |
| 4,332,635 | A | * | 6/1982 | Holbrook et al. | 156/256 |
| 4,337,719 | A | | 7/1982 | vander Griendt et al. | 118/46 |
| 4,345,393 | A | | 8/1982 | Price et al. | 40/312 |
| 4,368,665 | A | | 1/1983 | Boyle | 101/93.1 |
| 4,370,665 | A | * | 1/1983 | Scranton et al. | 347/16 |
| 4,372,457 | A | | 2/1983 | Kunimoto et al. | 215/228 |
| 4,529,871 | A | * | 7/1985 | Davidson | 235/383 |
| 4,559,729 | A | | 12/1985 | White | 40/306 |
| 4,561,921 | A | * | 12/1985 | Treiber | 156/297 |
| 4,587,926 | A | * | 5/1986 | Dominico | 118/211 |
| 4,612,079 | A | * | 9/1986 | Ostrow | 156/497 |
| 4,620,664 | A | | 11/1986 | Kaufman et al. | 229/233 |
| 4,813,355 | A | * | 3/1989 | Stork | 101/288 |
| 4,834,240 | A | | 5/1989 | Dagostine | 206/459.5 |

(Continued)

OTHER PUBLICATIONS

Rockwell Automation, Allen–Bradley, Programmable Limit Switch (PLS) and Die/Automation Monitor (DM) Software for SLC Processors, Jun. 1996.*

The IEEE Standard Dictionary of Electral and Electronics Terms, Sixth Edition 1996.*

Technical Drawings "6'Extended Snorkle for Berry Plastic", Nov. 16, 1999.*

*Primary Examiner*—Daniel J. Colilla
*Assistant Examiner*—Wasseem H. Hamdan
(74) *Attorney, Agent, or Firm*—Barnes & Thornburg LLP

(57) ABSTRACT

An apparatus for printing and labeling an object such as a container is provided. The apparatus includes a printer and a label applicator. The object is presented to both the printer and the label applicator during processing.

20 Claims, 6 Drawing Sheets

U.S. PATENT DOCUMENTS 4,846,504 A 7/1989 MacGregor et al. ..... 283/102
4,892,184 A * 1/1990 vander Griendt et al. ..... 198/476.1
4,936,208 A * 6/1990 Tielrooy ..... 101/40
5,074,462 A 12/1991 Countee, Jr. ..... 229/155
5,076,613 A 12/1991 Kovacs ..... 206/459.2
5,120,392 A * 6/1992 Butkevich et al. ..... 156/566
5,191,979 A 3/1993 Nemeroff ..... 283/106
5,232,540 A * 8/1993 Southwell et al. ..... 156/361
5,240,173 A 8/1993 Dagostine ..... 229/103.2
5,355,797 A 10/1994 Tielrooy ..... 101/177
5,409,754 A 4/1995 Yasuda et al. ..... 428/43
5,425,823 A * 6/1995 Woodside, III ..... 156/64
5,433,572 A * 7/1995 Swain et al. ..... 414/27
5,435,862 A * 7/1995 Williams et al. ..... 156/64
5,540,795 A * 7/1996 Franklin et al. ..... 156/64
5,550,745 A * 8/1996 Wurz ..... 700/215
5,697,549 A 12/1997 Yocum ..... 229/400
5,713,679 A * 2/1998 Taylor ..... 400/621
5,799,574 A * 9/1998 Williams et al. ..... 101/40
5,839,581 A 11/1998 Vagedes ..... 206/459.1
5,839,599 A 11/1998 Lin ..... 220/62.12
5,843,252 A * 12/1998 Murphy ..... 156/64
5,865,918 A * 2/1999 Franklin et al. ..... 156/64
D410,677 S * 6/1999 Matsumoto et al. ..... D18/53
5,954,913 A 9/1999 Wurz et al. ..... 156/360
5,970,865 A * 10/1999 Horth et al. ..... 101/40
5,992,892 A * 11/1999 Schaefer et al. ..... 215/383
5,996,664 A * 12/1999 Gregoire ..... 156/350
5,996,887 A 12/1999 Cai et al. ..... 229/400
6,006,808 A * 12/1999 Ewert et al. ..... 156/556
6,027,018 A 2/2000 Yocum ..... 156/78
6,139,665 A 10/2000 Schmelzer et al. ..... 229/400
6,142,331 A 11/2000 Breining et al. ..... 220/62.12
6,143,105 A * 11/2000 Nash et al. ..... 156/64
6,179,030 B1 * 1/2001 Rietheimer ..... 156/360
6,206,570 B1 3/2001 Cortopassi ..... 383/127
6,237,843 B1 5/2001 Falat et al. ..... 229/125.3
6,257,136 B1 * 7/2001 McCoy et al. ..... 101/38.1
6,257,294 B1 * 7/2001 Weisbeck ..... 156/356
6,389,971 B1 * 5/2002 McKillip ..... 101/494
6,811,648 B1 11/2004 Dominico ..... 156/277

* cited by examiner 12
13
15
18
20
21
22
23
24
25
26
27
28
30
31
32
34
40
50
58
60
62
70
72
74
82
tnemnt
emne

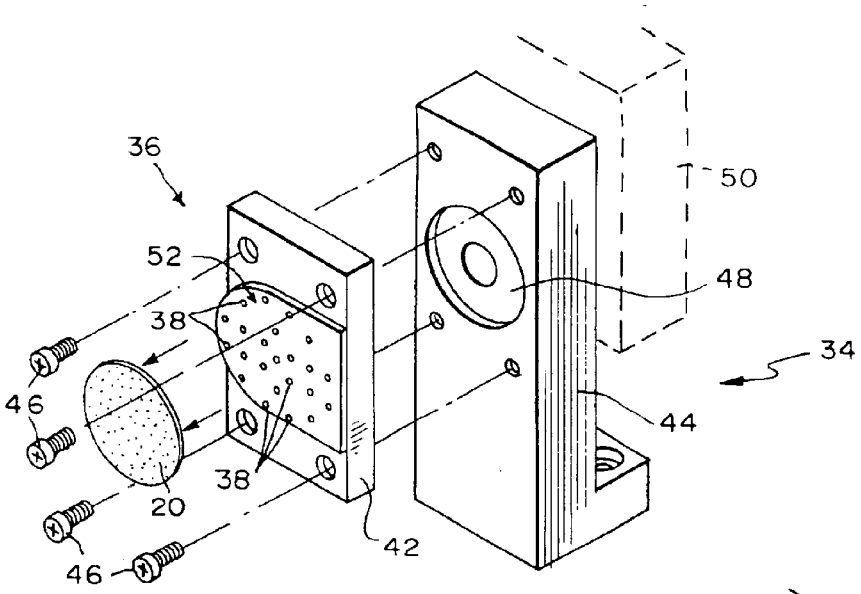
FIG. 6
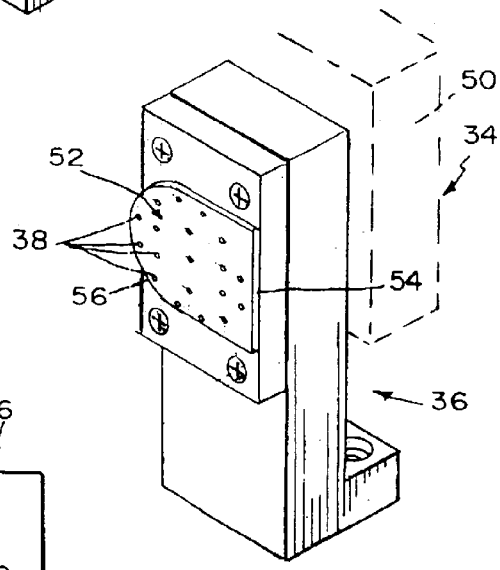
FIG. 7
FIG. 8
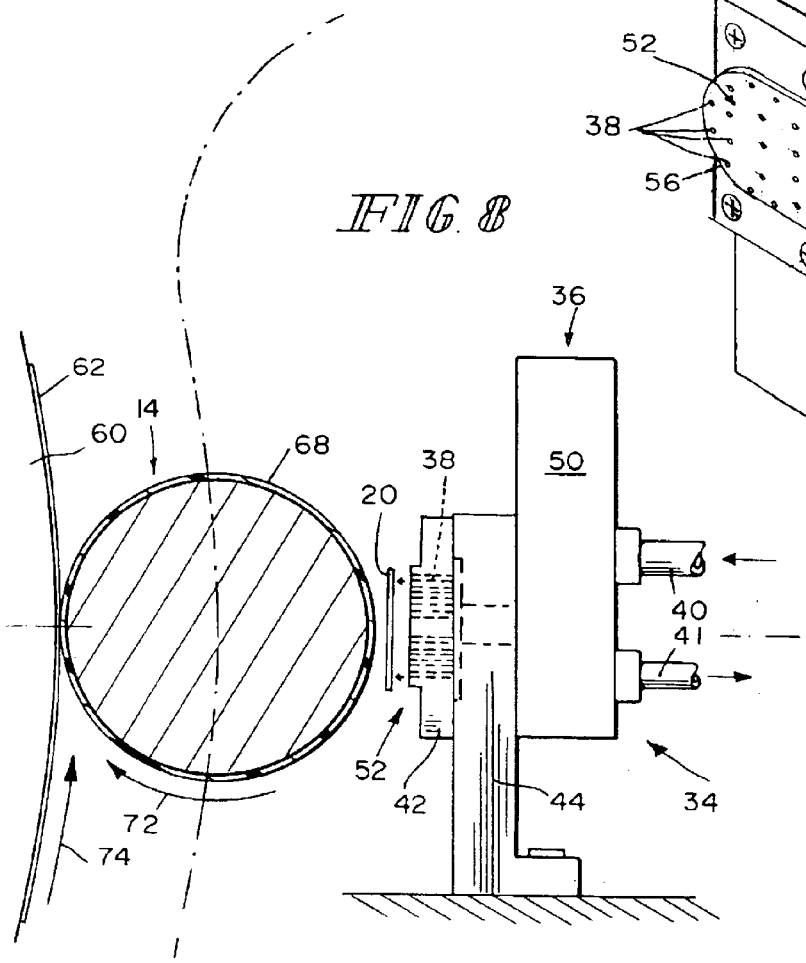

CONTAINER-LABELING AND-PRINTING SYNCHRONIZATION APPARATUS AND PROCESS

BACKGROUND AND SUMMARY OF THE INVENTION

The present invention relates to a printing machine. More particularly, the present invention relates to a label applicator for use with an offset printer for printing and labeling containers.

It is desirable to apply a printed image to containers such as cans and cups. Such a printed image may be an advertisement, decorative image, or any other desirable print for a surface of the container. It has become desirable to additionally apply a label to the container so that the label is positioned at a prescribed location relative to the printed image. For example, the label may be a game piece, or a coupon good toward the purchase of a product.

In this specification and in the attached claims, the word "label" is intended to apply to any item which is configured to be attached to a container in a predetermined location to provide information or to serve as a game piece or coupon. A game piece is illustratively a one-, two-, or multiple-ply label that typically includes a portion separable by a consumer to expose an indication of whether the consumer wins some kind of prize related to the contest or promotion.

According to the present disclosure, an apparatus is provided for applying a label to an object such as a container, can, or cup during the process of printing an image on the object. It should be understood, however, that the present disclosure is not limited to application of labels only to containers.

The apparatus comprises a printer and a label applicator coupled to the printer. Illustratively, a holder engages the object and moves the object relative to the printer and the label applicator. The label applicator applies a label to a first surface area of the object when the first surface area is near the label applicator. The printer prints an image on a second surface area of the object when the second surface area is near the printer.

The application of the label to the object is coordinated with the printing of an image on the object. With such coordination, the label can be positioned in a prescribed or predetermined position relative to the printed image.

According to an illustrated embodiment, the label applicator is positioned relative to the printer so that the label can be applied to the first surface area of the object at substantially the same time that the image is printed on the second surface area of the object. The label applicator includes a retainer for retaining the label in a first position for a prescribed period of time while the object is being printed. Illustratively, the object is rotated while being printed. At the proper time, the retainer moves the label toward the object. A control system couples the printer to the label applicator to coordinate the printing of the object such that the label is in a predetermined position relative to the printed image. The control system may include a processor coupled to the printer and a second processor coupled to the label applicator.

The illustrative control system includes a programmable limit switch coupled to the printer, wherein the programmable limit switch is configured to determine the position of the object relative to the printer and report that position via outputs. The illustrative control system further includes an actuator coupled to the label applicator and coupled to the outputs of the programmable limit switch, wherein the actuator is configured to control the label applicator in response to signals from the programmable limit switch. Illustratively, the control system may include a resolver and/or an encoder configured to determine the cycle position of the apparatus.

Vacuum pressure is used to retain the label in the first position, and positive pressure (in the form of an air blast) is used to move the label toward the object. In an illustrative embodiment, the label is applied to the object prior to the completion of printing, and printed image is omitted from the portion of the object covered by the label.

It will be appreciated that one aspect of the invention is a combination of a container printer and a label applicator. The label applicator is configured to apply a label to a prescribed area of each container while each container rotates about an axis. The printer comprises a printing head and a container feeder that is configured to present each container to the printing head. Each container rotates about its own axis adjacent the printing head, while the label applicator is positioned and configured to apply a label to each container during its rotation.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 6 is an assembly view of a label retainer configured to retain a label in a first position for a prescribed period of time and then move the label toward the container, FIG. 7 is a perspective view of the label retainer of FIG. 6;

FIG. 8 is a side sectional view of the label retainer and container taken along the line 8—8 of FIG. 3, showing the label being moved toward the container by forced air originating from the label retainer.

DETAILED DESCRIPTION OF THE DRAWINGS

Figure 1:
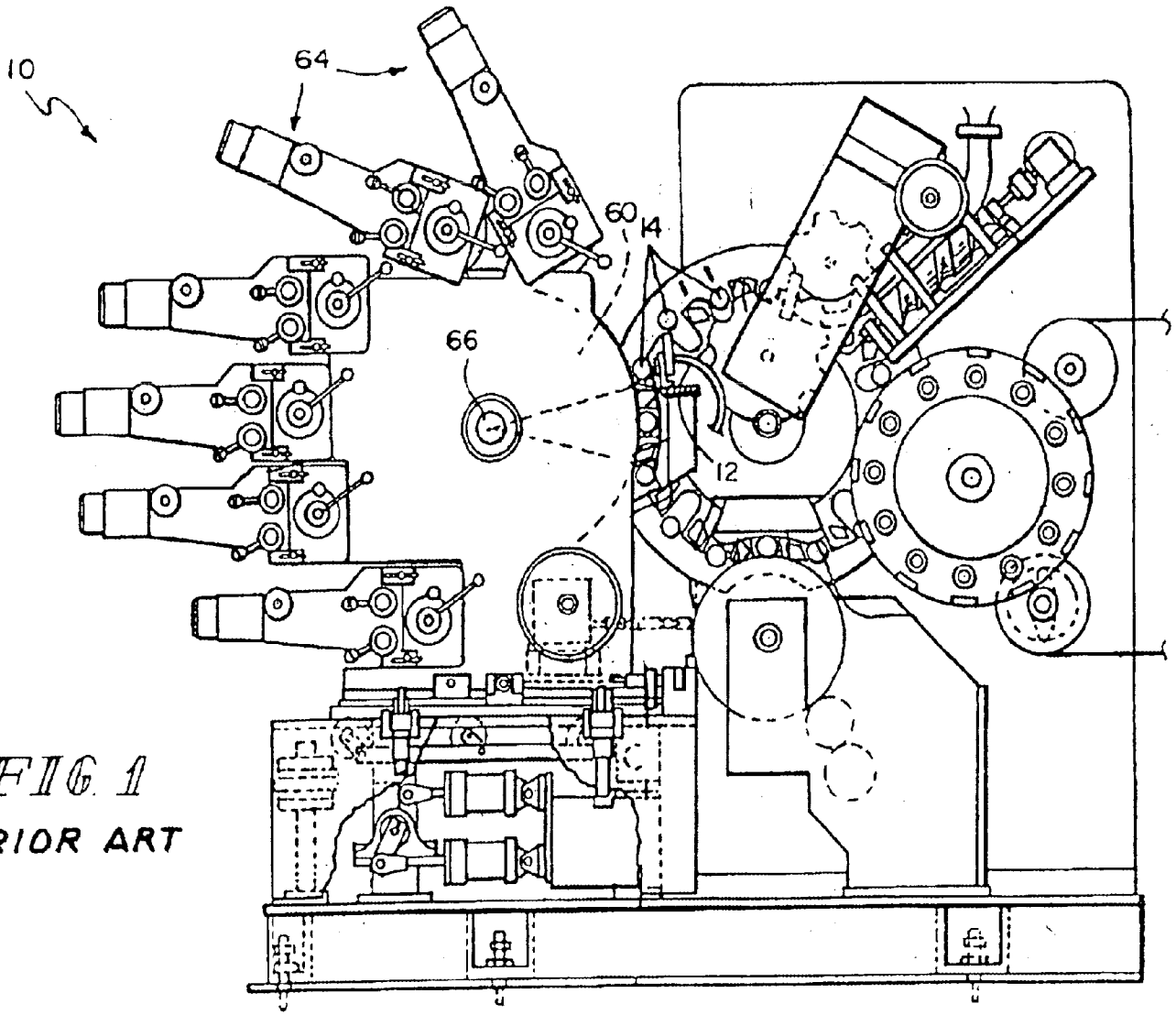
FIG. 1 PRIOR ART
FIG. 1 (Prior Art) is a front elevational view of an offset printer having a label applicator according to the present invention.
Figure 2:
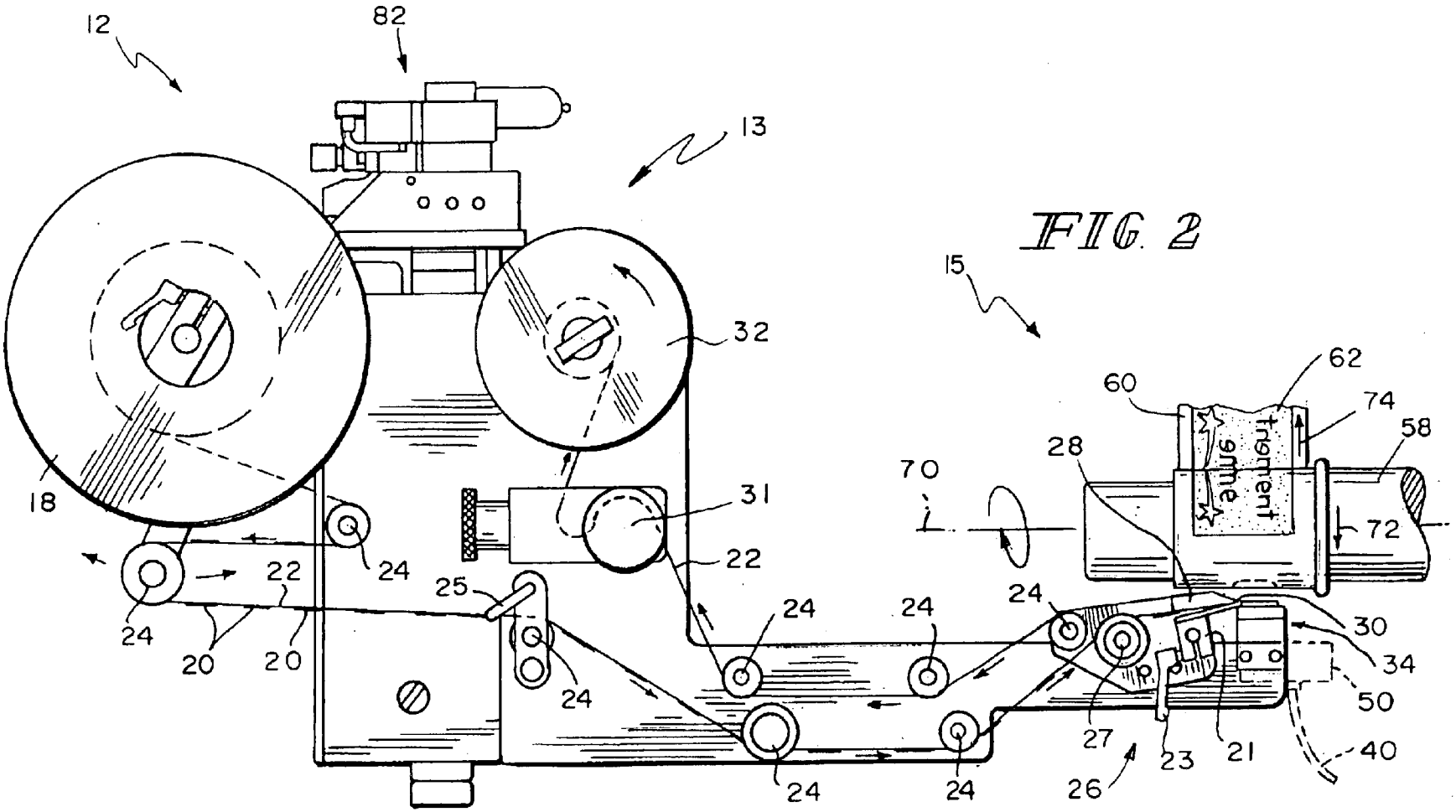
FIG. 2 is a top view of the label applicator showing a label dispensing reel providing labels with a backing to an applicator head, the applicator head positioning the label for placement on the container, and an intake reel for collecting the backing after the label has been removed.

A machine such as an offset printer 10, as shown in FIG. 1, includes a label applicator 12, shown in more detail in FIG. 2. Illustratively, label applicator 12 is configured to apply a label to a container 14 at a predetermined position relative to a printed image 16 applied to the container by the offset printer 10. Illustratively, the controls of the printer 10 and the controls of the label applicator 12 are coupled together such that the image is printed on the container 14 and a label is applied to the container 14 when the container 14 is being held and moved adjacent a print wheel 60.

The illustration in FIG. 1 depicts an embodiment of applicant's invention including a Van Dam Machine B.V., printer, and such printer is shown for example in U.S. Pat. No. 4,337,719. The printer portion can be purchased from Van Dam Machine B.V., Amsterdam, Netherlands. The embodiment shown in FIG. 1 is shown to feed containers such as caulking containers, however, FIGS. 2–8 show embodiments configured to print containers such as cups. The Van Dam Machine U.S. Pat. No. 4,337,719 is incorporated herein by reference for the purposes of describing the nature of such container printers. It will be appreciated, however, that the label applicator 12 may be coupled with printers of various types manufactured by various entitles.

Label applicator 12 includes a label feeder 13, an arm 15 (often referred to in the art as a snorkel) extending from the label feeder into offset printer 10, and a retainer 34. Label feeder 13 includes a label dispensing reel 18 for supplying adhesive labels 20 on a backing 22, as shown in FIG. 2. Backing 22 is directed through directing rollers 24 past applicator head 26 to intake reel 32 by tension applied by takeup roller 31. As backing 22 moves through applicator head 26, labels 20 are removed from backing 22 and subsequently applied to an object, such as a container 14. Illustratively, label feeder 13 (also known as a "label head" in the art) is manufactured by CTM Integration Inc. of Salem, Ohio as model 360. The label applicator 12, as ordered from CTM Integration Inc., is supplied with a processor-type control system (referred to as an actuator herein) to be described hereinafter, which control system is coupled to the printer control system (referred to as a programmable limit switch 80 herein).

Illustratively, label applicator 12 is also provided with adjustment levers 23, 25. Adjustment lever 23 provides for movement of pressure arm 21, the pressure arm 21 configured to position backing 22 and labels 20 proximate to peel plate 28. Adjustment lever 25 provides adjustment of a brush (not shown) for optimal tracking of backing 22.

Figure 3:
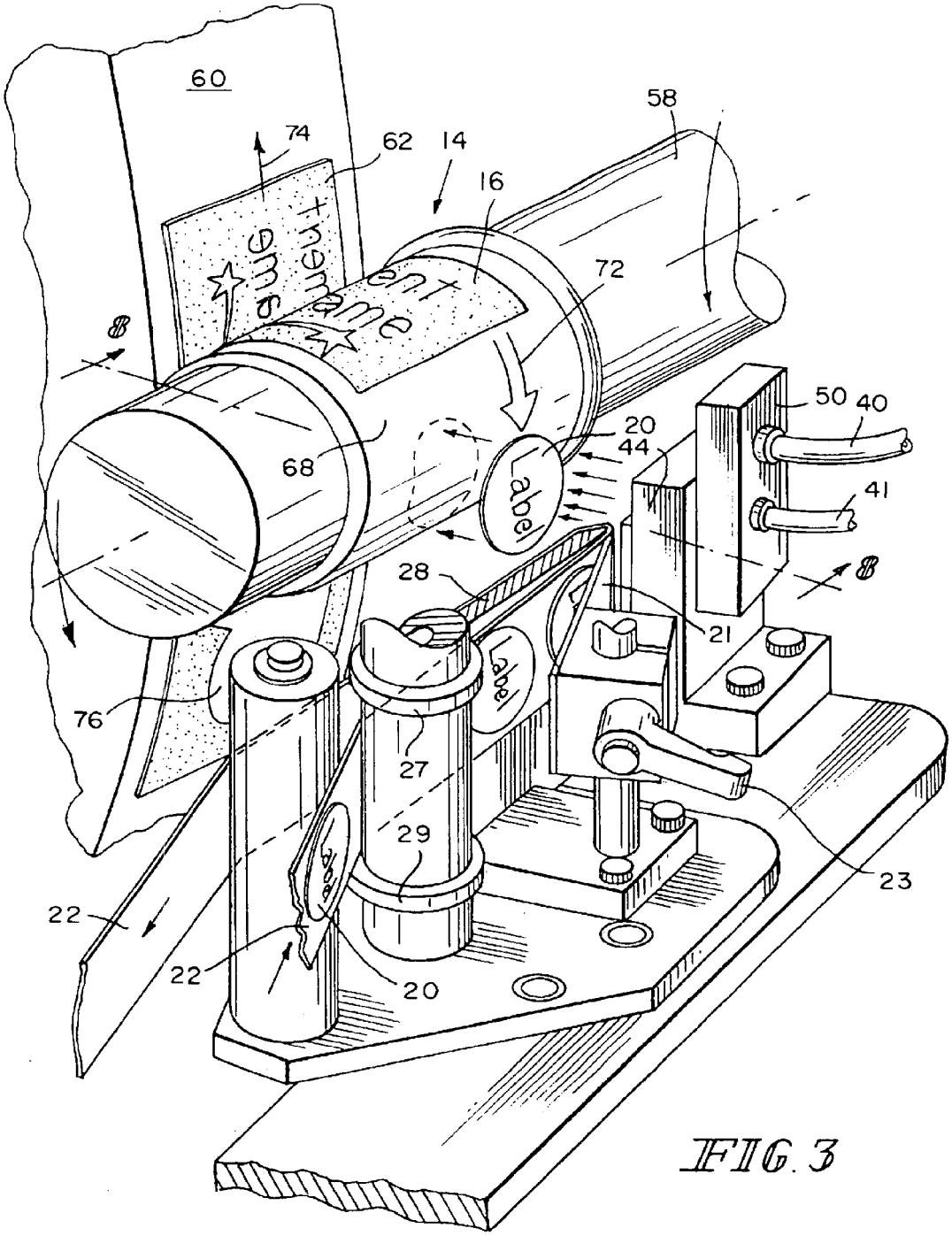
FIG. 3 is a perspective view of the applicator head in cooperation with a printer wheel and a container carried by a mandrel, the printer wheel printing the container and the applicator head applying a label to the container.
Figure 5:
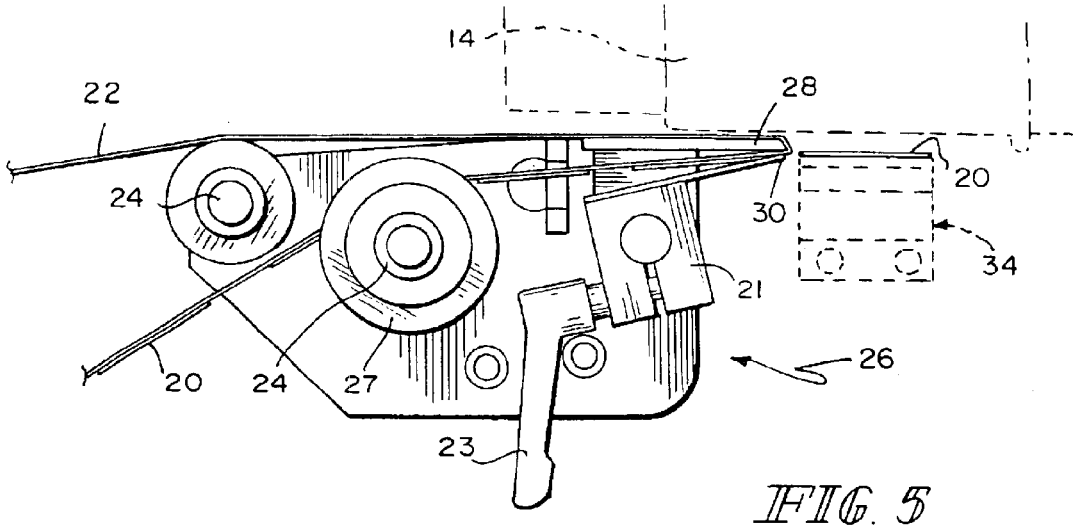
FIG. 5 is a top view of the peel plate assembly of FIG. 4, showing the path of the labels on the label backing, and showing the return path of the label backing.
Figure 4:
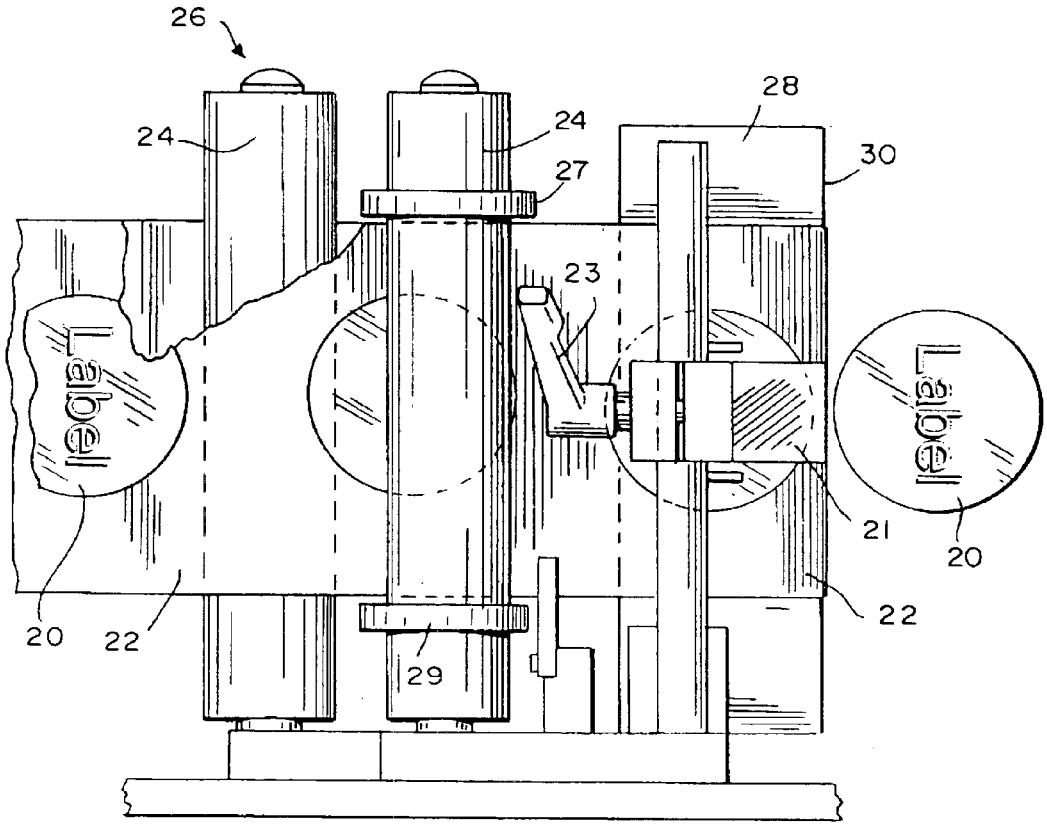
FIG. 4 is a fragmentary view looking upwardly at the applicator head at the right hand side of FIG. 2, showing the peel plate assembly and directing rollers.

In the illustrative embodiment, arm 15 includes a peel plate 28, as shown in detail in FIGS. 3–5. Arm 15 further includes backing guides 27, 29 positioned on one of the directing rollers 24, the backing guides 27, 29 providing desired vertical positioning of backing 22 and associated labels 20. As backing 22 passes between pressure arm 21 and peel plate 28, and sharply turns about an edge 30 of peel plate 28, label 20 is caused to separate from backing 22, as shown in FIGS. 3–5. Label 20 is sufficiently rigid in order to overcome the adhesive bias toward backing 22 when backing 22 is caused to make a sharp turn, such as is required at edge 30 of peel plate 28. Backing 22 then proceeds to intake reel 32, shown in FIG. 2, where it is collected.

Upon separation from backing 22, label 20 is retained by a retainer 34. Retainer 34 can be any suitable means for temporarily retaining label 20 in a first position prior to label 20 being transferred to container 14. Illustratively, as shown in FIG. 5, retainer 34 is a pneumatically powered head capable of first applying a vacuum pressure to label 20 to retain it against retainer 34, and then applying positive pressure against label 20, thereby propelling it toward container 14.

In the preferred embodiment shown in FIGS. 3, 6, 7 and 8, retainer 34 is a Reverse Vacuum Blow (RVB) head 36 configured to use the same apertures 38 which alternately apply either vacuum pressure or positive pressure to label 20. RVB head 36 is actuated by positive pressure feed 40, vacuum pressure feed 41, and air valve 50, which are in communication with apertures 38.

RVB head 36, as shown in assembly view in FIG. 6, includes pad 42 fastened to base 44 with fasteners 46. Base 44 includes a recessed area 48 that permits transfer of positive or vacuum pressure to apertures 38. The positive and vacuum pressures are provided by positive pressure feed 40 and vacuum pressure feed 41, respectively. RVB head 36 further includes valve 50 which controls the flow of pneumatic pressure from pneumatic feed 40. Valve 50 in turn is controlled by actuator 82 as discussed further below.

Illustratively, pad 42 is configured to have a raised portion 52 having a flat side 54, shown in FIG. 7, and a rounded side 56. Flat side 54 of pad 42 is adapted to receive a label 20 as it is separated from backing 22 without causing interference to the transfer of label 20 from backing 22 to RVB head 36.

Offset printer 10 operates substantially as follows. Objects, such as containers 14, are fed into offset printer 10 and positioned on holders such as the illustrative mandrels 58 (shown in FIG. 2). In the disclosed embodiment, mandrels 58 apply a vacuum pressure to each container 14 in order to secure the container to the mandrel during processing. Each container 14 is then directed with mandrel 58 to a position such that the container 14 is disposed near or proximate to a print wheel 60. Print wheel 60 can be any container-printing device known in the art, and illustratively includes printing blankets 62 mounted on the periphery of print wheel 60. Print wheel 60 rotates about a central axis 66, as seen from FIG. 1. The rotational movement of print wheel 60 cyclically presents printing blankets 62 before inking units 64, whereby each inking unit 64 applies a certain color of ink to print blankets 62 for eventual transfer to containers 14.

Illustratively, print wheel 60 moves counterclockwise about central axis 66 as seen from FIG. 1 such that it is moving upward in direction 74 when disposed near container 14, as shown in FIGS. 2 and 3. This counterclockwise movement is used for ease of illustration purposes only, and in an actual embodiment of the present invention, offset printer 10 has been configured for clockwise movement of print wheel 60 about central axis 66, thereby resulting in print wheel 60 moving downward when disposed near container 14.

As each container 14 is positioned to be disposed near print wheel 60, a printing blanket 62 contacts outer surface 68 of container 14, as shown in FIGS. 2 and 3. Container 14 is carried by mandrel 58 such that container 14 rotates in direction 72 about the container's own axis 70, as shown in FIG. 2, when it contacts printing blanket 62. When container 14 contacts printing blanket 62, a printed image 16 is imparted on container 14 by printing blanket 62, as shown in FIGS. 2 and 3.

Figure 9:
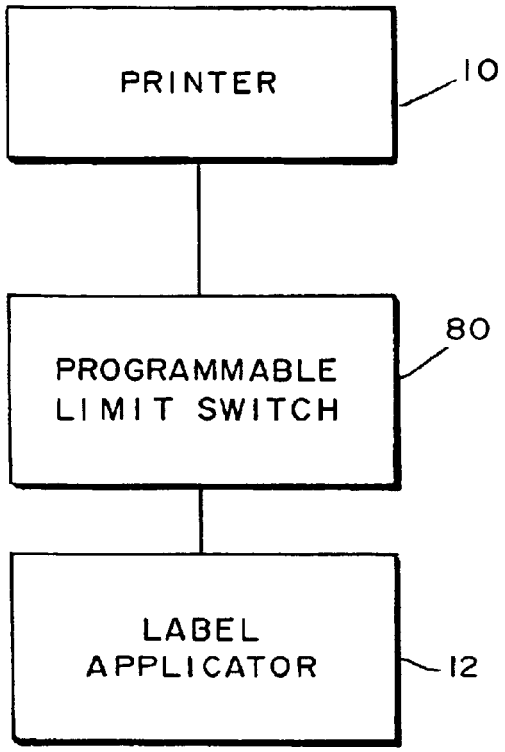
FIG. 9 is a diagrammatic representation of the coupling of the offset printer with a controller or programmable limit switch, and the coupling of the controller with the label applicator, which also has a controller (referred to as an actuator herein).

As print wheel 60 and printing blanket 62 cooperate to impart a printed image 16 on container 14, label applicator 12 operates to apply a label on the container 14 at a prescribed position relative to printed image 16, as shown in FIG. 3. An encoder or programmable limit switch 80, shown diagrammatically in FIG. 9, is coupled with offset printer 10 and assists with the coordination and control of various operations synchronized with the functioning of print wheel 60. Illustratively, programmable limit switch 80 is a Plus PS-6144 Series Programmable Limit Switch, available from Electro Cam Corp. of Roscoe, Ill., the Programming and Installation Manual of which (dated Jul. 9, 1997) is incorporated herein by reference.

The illustrative programmable limit switch 80 utilizes a resolver to indicate the relative cycle positions of the offset printer 10 and the object being printed. The Plus PS-6144 Series model resolver uses fixed and rotating coils of wire to generate an electronic signal that represents a shaft position. It will be appreciated, therefore, that such printers as the illustrative Van Dam Machine, B.V. printer may have controls, encoders, resolvers, etc. establishing the relative position of the print wheel 60. Illustratively, in accordance with the present invention, the outputs of such printer controls are coupled to the label applicator 12 to coordinate the label applicator with the operation of the offset printer 10.

For example, in the illustrative embodiment, programmable limit switch 80 includes at least one spare output channel for communicative coupling with label applicator 12. Illustratively, the Plus PS-6144 model disclosed above includes a spare output "channel 13" (not shown) which is coupled with an input of actuator 82 (shown in FIG. 2) of label applicator 12. Actuator 82 coordinates the functioning of the label applicator 12 with offset printer 10 based upon signals delivered through the spare output channel of the programmable limit switch 80. Additionally, actuator 82 is coupled with a ground on the Plus PS-6144 model programmable limit switch 80. Actuator 82 is included as part of the label feeder 13 available from CTM Integration Inc. as model 360, as discussed above.

Upon receiving the signal from the spare output channel, actuator 82 signals for label applicator 12 to apply a label 20 at a predetermined position on the container 14 using the process described herein. Each signal from the spare output channel of programmable limit switch 80 prompts actuator 82 to advance one cycle, thereby applying one label 20 to one container 14. The label applicator 12 "on" and "off" points relative to the cycle position can be adjusted with a keypad (not shown) provided with the programmable limit switch 80. In the illustrated embodiment, the actuator 82 is communicatively coupled with takeup roller 31 and valve 50 of applicator head 26 such that, upon signaling from the spare output channel, actuator 82 directs takeup roller 31 to advance, thereby presenting a label 20 to peel plate 28. In conjunction with peeling of a label from backing 22, valve 50 functions as described below to apply a label 20 to the presented container 14.

Label 20 separates from backing 22 as backing 22 corners around peel plate 28, as shown in FIG. 4. Upon separation from backing 22, label 20 is retained by retainer 34 until retainer 34 is signaled by the programmable limit switch 80 to initiate the transfer of label 20 to container 14. Illustratively, retainer 34 is an RVB head 36, as disclosed above, the RVB head being activated by valve 50 in combination with pneumatic feed 40. In the illustrated embodiment, RVB head 36 retains label 20 with vacuum pressure conducted through apertures 38. Upon signal from the programmable limit switch 80 to valve 50, RVB head 36 then applies positive pressure to apertures 38, forcing label 20 toward container 14.

During the printing process (while container 14 is in contact with printing blanket 62), container 14 rotates about its axis 70 at a high rate of speed, i.e. 300–600 RPM. In order to ensure proper application of label 20, RVB head 36 sends label 20 toward container 14 at a high velocity. In the illustrative embodiment, an air blast is used to apply the positive pressure. The requisite label velocity is accomplished with the provision of a number of apertures 38, as shown in FIGS. 6 and 7, in combination with a high flow velocity air circuit and valve 50. However, valve 50 also has fast response characteristics, so that the air blast can be short. A short air blast minimizes air turbulence, thereby substantially preventing the tearing of label 20 when it begins to attach to the rapidly rotating container 14. Illustratively, valve 50 is an air valve manufactured by MAC Valves, Inc. of Wixom, Mich. under the product number 811C-PM-611CA-152 with MOD 3727, and is signaled to operate by actuator 82.

During and after application of label 20 to container 14, container 14 continues to rotate in direction 72, as shown in FIG. 3. In the illustrative embodiment, printing blanket 62 is recessed at an area 76 corresponding to the applied label 20 on container 14. Recessed area 76 is substantially aligned with label 20, as applied to container 14, such that no printing occurs over label 20 after it is applied. It should be understood that recess area 76 is not required, however, for printing to be omitted over label 20. The inking of printing blankets 62 can be controlled such that no ink is applied in the area of printing blankets 62 that will contact label 20.

Application of label 20 during the printing process eliminates a secondary operation that is more costly and largely duplicative in steps. If a label were to be applied after printing, the containers would first need to be loaded onto another machine, the machine would have to align the containers and search for the desired labeling area, and then apply the label. These extra steps and the extra machine are unnecessary with the use of the disclosed invention.

Although the invention has been described in detail with reference to certain preferred embodiments, variations and modifications exist within the scope and spirit of the invention as described and defined in the following claims.

What is claimed is:

1. An apparatus for applying a label to an object such as a container or cup, the apparatus comprising a printer, a label applicator coupled to the printer, a holder configured to engage the object and move the object relative to the printer and the label applicator, the label applicator configured to apply a label to a surface of the object when the object is disposed near the label applicator, and the printer configured to print an image on the same surface of the object when the object is disposed near the printer, a control system coupling the printer and the label applicator to coordinate the printing of the object such that the label is in a predetermined position relative to the printed image, wherein the control system includes a programmable limit switch coupled to the printer, the programmable limit switch being configured to provide output signals determining the position of the object relative to the printer, and wherein the control system further includes an actuator coupled to the label applicator and coupled to the programmable limit switch, the actuator being configured to control the label applicator in response to the output signals from the programmable limit switch.

2. The apparatus of claim 1, wherein the programmable limit switch is an encoder coupled to the printer, the encoder being configured to determine a cycle position of the machine.

3. The apparatus of claim 1, wherein the programmable limit switch includes a resolver coupled to the printer, the resolver being configured to determine a cycle position of the machine.

4. The apparatus of claim 1, wherein the programmable limit switch includes outputs for communicating the relative positions of the printing head and the container.

5. An apparatus for applying a label to an object such as a container or cup, the apparatus comprising a printer, a label applicator coupled to the printer, a holder configured to engage the object and move the object relative to the printer and the label applicator, the label applicator configured to apply a label to a surface of the object when the object is disposed near the label applicator, and the printer configured to print an image on the same surface of the object when the object is disposed near the printer, a control system coupling the printer and the label applicator to coordinate the printing of the object such that the label is in a predetermined position relative to the printed image, wherein the control system includes a programmable limit switch coupled with the printer for providing a signal to the label applicator of the cycle status of the printer, and wherein the label applicator further includes an actuator coupled to the programmable limit switch for actuating the label applicator in response to the signal from the programmable limit switch.

6. The apparatus of claim 5, wherein the programmable limit switch is an encoder coupled to the printer, the encoder being configured to determine a cycle position of the machine.

7. The apparatus of claim 5, wherein the programmable limit switch includes a resolver coupled to the printer, the resolver being configured to determine a cycle position of the machine.

8. The apparatus of claim 5, wherein the programmable limit switch includes outputs for communicating the relative positions of the printing head and the container.

9. A machine for printing images on containers and applying labels to the containers, the machine configured to hold the containers, the machine comprising a printer configured to apply an image to each container, a label applicator coupled to the printer and configured to apply a label to each container at a prescribed location relative to the image while the image is being applied by the printer, a control system configured to coordinate the application of the label with the application of the image, wherein the control system comprises a programmable limit switch coupled to the printer, the programmable limit switch being configured to determine the cycle position of the printer relative to container, and wherein the control system further comprises an actuator coupled to the label applicator, the actuator being configured to communicate with the programmable limit switch and coordinate the operation of the label applicator with the operation of the printer.

10. The machine of claim 9, wherein the programmable limit switch is an encoder coupled to the printer, the encoder being configured to determine a cycle position of the machine.

11. The machine of claim 9, wherein the programmable limit switch includes a resolver coupled to the printer, the resolver being configured to determine a cycle position of the machine.

12. The machine of claim 9, wherein the programmable limit switch includes outputs for communicating the relative positions of the printing head and the container.

13. In a machine for printing images on containers, each container being presented by the machine to receive an image, the improvement comprising a label applicator carried on the machine and configured to apply a label to each container as the container is processed by the machine, a control system configured to coordinate the application of the label with the application of the image, wherein the control system includes a programmable limit switch configured to determine and report a cycle position of the machine, and wherein the control system further includes an actuator configured to communicate with the programmable limit switch and coordinate the application of the label with the receipt of the image by the container.

14. The improvement of claim 13, wherein the programmable limit switch is an encoder coupled to the printer, the encoder being configured to determine a cycle position of the machine.

15. The improvement of claim 13, wherein the programmable limit switch includes a resolver coupled to the printer, the resolver being configured to determine a cycle position of the machine.

16. The improvement of claim 13, wherein the programmable limit switch includes outputs for communicating the relative positions of the printing head and the container.

17. The combination of a container printer and a label applicator configured to apply a label at a prescribed area of each container, each container having an axis about which it rotates, the printer comprising a printing head and container feeder configured to present each container to the printing head with each container rotating about its own axis adjacent the printing head, the label applicator being positioned and configured to apply a label to each container during its rotation, the combination further comprising a control system for coordinating the presentation of each container to the printing head with the application of a label, wherein the control system comprises a programmable limit switch configured to determine the cycle status of the container printer and coordinate the operation of the container printer based on the cycle status, and wherein the control system further comprises an actuator configured to communicate with the programmable limit switch and direct the operation of the label applicator based on the communication with the programmable limit switch.

18. The combination of claim 17, wherein the programmable limit switch is an encoder coupled to the printer, the encoder being configured to determine a cycle position of the machine.

19. The combination of claim 17, wherein the programmable limit switch includes a resolver coupled to the printer, the resolver being configured to determine a cycle position of the machine.

20. The combination of claim 17, wherein the programmable limit switch includes outputs for communicating the relative positions of the printing head and the container.

* * * * *